US005653580A

United States Patent [19]

Faulder et al.

[11] Patent Number: 5,653,580

[45] Date of Patent: Aug. 5, 1997

[54] NOZZLE AND SHROUD ASSEMBLY MOUNTING STRUCTURE

[75] Inventors: Leslie J. Faulder, San Diego, Calif.; Gary A. Frey, deceased, late of Seattle, Wash., by Beth A. Frey, heir; Engward W. Nielsen, El Cajon; Kenneth J. Ridler, San Diego, both of Calif.

[73] Assignee: Solar Turbines Incorporated, San Diego, Calif.

[21] Appl. No.: 399,954

[22] Filed: Mar. 6, 1995

[51] Int. Cl.[6] ..... F04D 29/44

[52] U.S. Cl. ..... 415/209.3; 415/137

[58] Field of Search ..... 415/135, 136, 415/137, 139, 189, 209.4, 209.3, 209.2

[56] References Cited

U.S. PATENT DOCUMENTS

| | | | |
|---|---|---|---|
| 2,851,246 | 9/1958 | Nichols | 415/136 |
| 3,062,499 | 11/1962 | Petersen | 415/137 |
| 3,423,071 | 1/1969 | Noren . | |
| 3,511,577 | 5/1970 | Karstensen | 415/137 |
| 4,121,843 | 10/1978 | Halling . | |
| 4,126,405 | 11/1978 | Bobo et al. . | |
| 4,314,793 | 2/1982 | DeTolla et al. | 415/137 |
| 4,643,636 | 2/1987 | Libertini et al. | 415/138 |
| 4,883,405 | 11/1989 | Walker . | |
| 5,062,767 | 11/1991 | Worley et al. . | |

FOREIGN PATENT DOCUMENTS

| | | |
|---|---|---|
| 2189632 | 1/1974 | France . |
| 2374508 | 7/1978 | France . |
| 2652383 | 3/1991 | France . |
| 1201852 | 9/1965 | Germany . |
| 1014577 | 12/1965 | United Kingdom . |
| 1123586 | 8/1968 | United Kingdom . |
| 1387866 | 3/1975 | United Kingdom . |
| 2236809 | 4/1991 | United Kingdom . |

*Primary Examiner*—John T. Kwon
*Attorney, Agent, or Firm*—Larry G. Cain

[57] ABSTRACT

The present nozzle and shroud assembly mounting structure configuration increases component life and reduces maintenance by reducing internal stress between the mounting structure having a preestablished rate of thermal expansion and the nozzle and shroud assembly having a preestablished rate of thermal expansion being less than that of the mounting structure. The mounting structure includes an outer sealing portion forming a cradling member in which an annular ring member is slidably positioned. The mounting structure further includes an inner mounting portion to which a hooked end of the nozzle and shroud assembly is attached. As the inner mounting portion expands and contracts, the nozzle and shroud assembly slidably moves within the outer sealing portion.

12 Claims, 3 Drawing Sheets

NOZZLE AND SHROUD ASSEMBLY MOUNTING STRUCTURE

BACKGROUND ART

"The Government of the United States of America has rights in this invention pursuant to Contract No. DE-AC21-93MC30246 awarded by the U.S. Department of Energy"

TECHNICAL FIELD

This invention relates generally to gas turbine engine components and more particularly to the structural design of a system for attaching a nozzle and shroud assembly within the gas turbine engine.

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of rotating blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to 1200 degrees Celsius. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical property and coefficient of thermal expansion to that of a metal structure, then undesirable stresses, a portion of which are thermal stresses, will be set up within the nozzle guide vanes and/or blades and between their supports when the engine is operating. Such undesirable thermal stresses cannot adequately be contained by cooling.

Furthermore, the sliding friction between the ceramic blade and the connecting structure creates a contact tensile stress on the ceramic that degrades the surface. This degradation in the surface of the ceramic occurs in a tensile stress zone of the blade root, therefore, when a surface flaw is generated in the ceramic of critical size, the airfoil will fail catastrophically.

One of the biggest challenges in designing successful ceramic components is insuring that tensile stresses within components remain low. High tensile stress can fracture ceramic components leading to catastrophic engine failures. For example, one such are of concern is at the point of joining the ceramic components to the metallic components. The difference in the rate of thermal expansion often induces undesirable tensile stress between the ceramic components and the metallic components.

The present invention is directed to overcome one or more of the problems as set forth above.

DISCLOSURE OF THE INVENTION

In one aspect of the present invention, a nozzle and shroud assembly has been adapted for use in a gas turbine engine having a mounting structure defining an outer sealing portion having a cradling member and an inner mounting portion. The nozzle and shroud assembly is comprised of an annular ring member having a first end surface, a second end surface and an outer axisymmetric surface. The first end surface, the second end surface and the outer axisymmetric surface are positioned within the cradling member. The outer axisymmetric surface is spaced from the cradling member forming a space therebetween. An inner annular ring structure has a hooked end being in contacting relationship with the inner mounting portion and an airfoil is interposed and attached to the outer annular ring member and the inner annular ring structure.

In another aspect of the invention a gas turbine engine is comprised of a mounting structure defining an outer sealing portion having a cradling member, and an inner mounting portion. The gas turbine engine is further comprised of an annular ring member having a first end surface, a second end surface and an outer axisymmetric surface. The first end surface, the second end surface and the outer axisymmetric surface are positioned within the cradling member and the outer axisymmetric surface is space from the cradling member forming a space therebetween. The gas turbine engine is further comprised of an inner annular ring structure having a hooked end being in contacting relationship with the inner mounting structure and an airfoil is interposed and attached to the outer annular ring member and the inner annular ring structure.

BEST MODE FOR CARRYING OUT THE INVENTION

Figure 1:
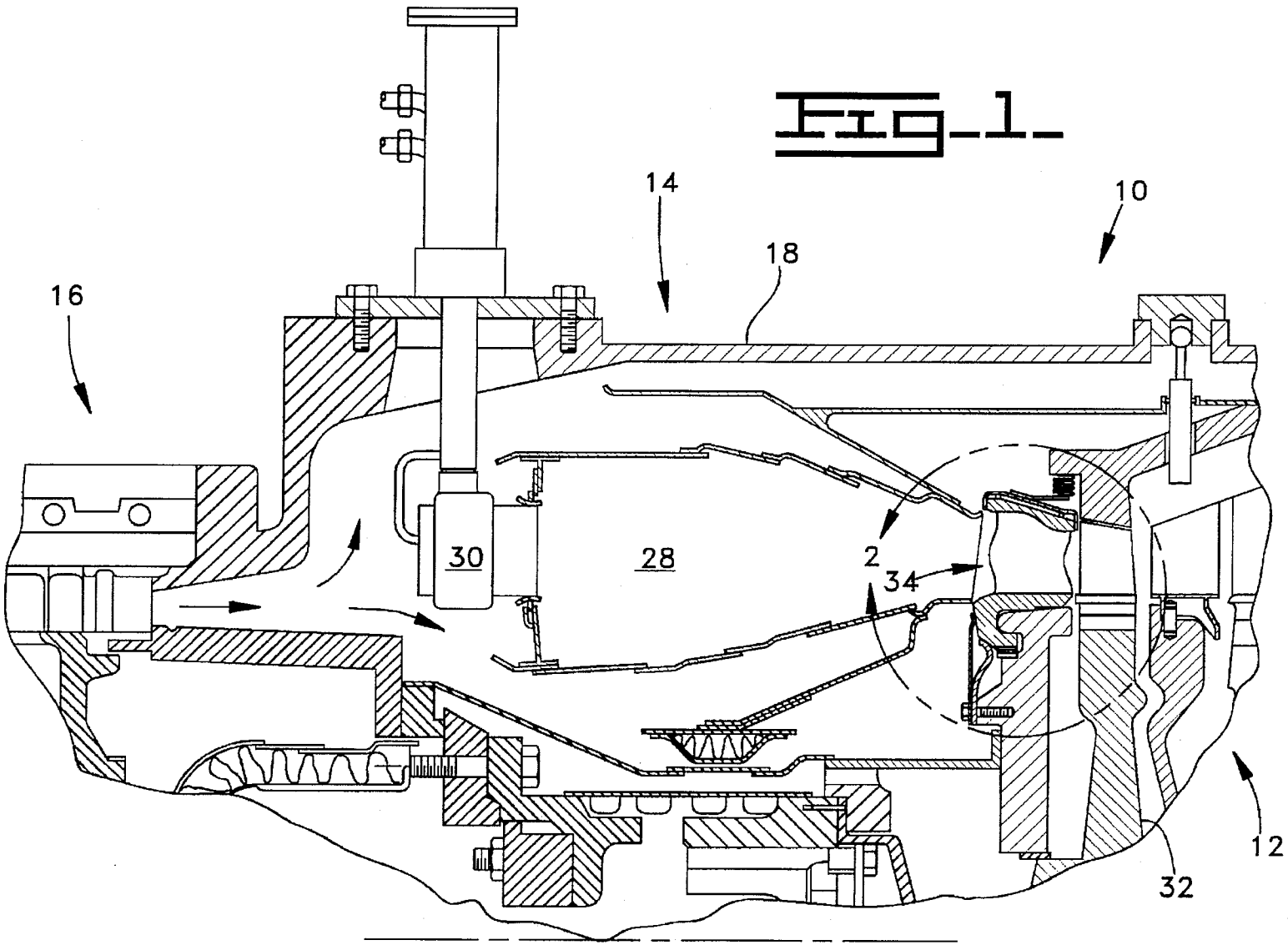
FIG. 1 is a sectional side view of a portion of a gas turbine engine embodying the present invention.
Figure 2:
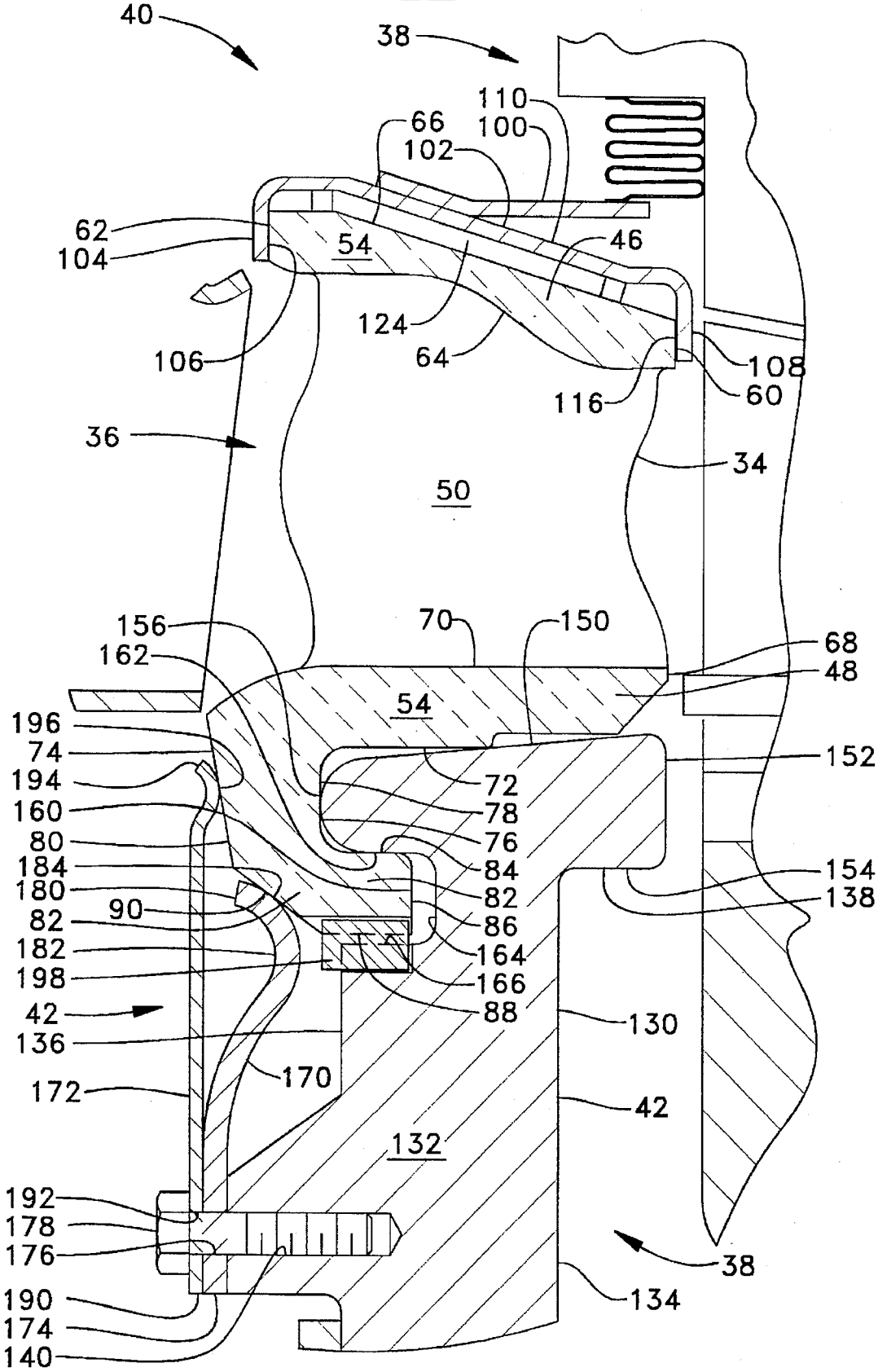
FIG. 2 is an enlarged sectional view of a portion of FIG. 1 taken along lines 2—2 of FIG. 1.

Referring to FIGS. 1 and 2, a gas turbine engine 10, not shown in its entirety, has been sectioned to show a turbine section 12, a combustor section 14 and a compressor section 16. The engine 10 includes an outer case 18 surrounding the turbine section 12, the combustor section 14 and the compressor section 16. The combustion section 14 includes a combustion chamber 28 having a plurality of fuel nozzles 30 (one shown) positioned in fuel supplying relationship to the combustion section 14 at the end of the combustion chamber 28 near the compressor section 16. The turbine section 12 includes a first stage turbine 32 disposed partially within an integral first stage nozzle and shroud assembly 34. The assembly 34 is supported within the outer case 18 by a mounting means 36 to a mounting structure 38 having a preestablished rate of thermal expansion. The mounting structure 38 includes an outer sealing portion 40 being attached to the outer case 18 in a conventional manner and an inner mounting portion 42 being attached to the gas turbine engine in a conventional manner. In this application, the nozzle and shroud assembly 34 includes a plurality of segmented members 44, only one being shown, being interconnected to form the nozzle and shroud assembly 34. In the assembled position the nozzle and shroud assembly 34 includes an outer annular ring member an inner annular ring structure 48 and a plurality of airfoils or vanes 50 fixedly attached thereto each or either of the outer annular ring member 46 and the inner annular ring structure 48. In this application, the outer annular ring member 46, the inner annular ring structure 48 and the plurality of airfoils 50 are made of a ceramic material and have a lower rate of thermal expansion than the mounting structure 38 and primary components of the gas turbine engine 10. Furthermore, in this application, the airfoils 50 are fixedly attached to each of outer annular ring member 46 and the inner annular ring structure 48.

Although the nozzle and shroud assembly 34 includes the plurality of segmented members 44 the assembly 34 could be a single structure without changing the essence of the invention. The plurality of segmented members 44 are radially divided between a first end 52 and a second end 54.

Figure 3:
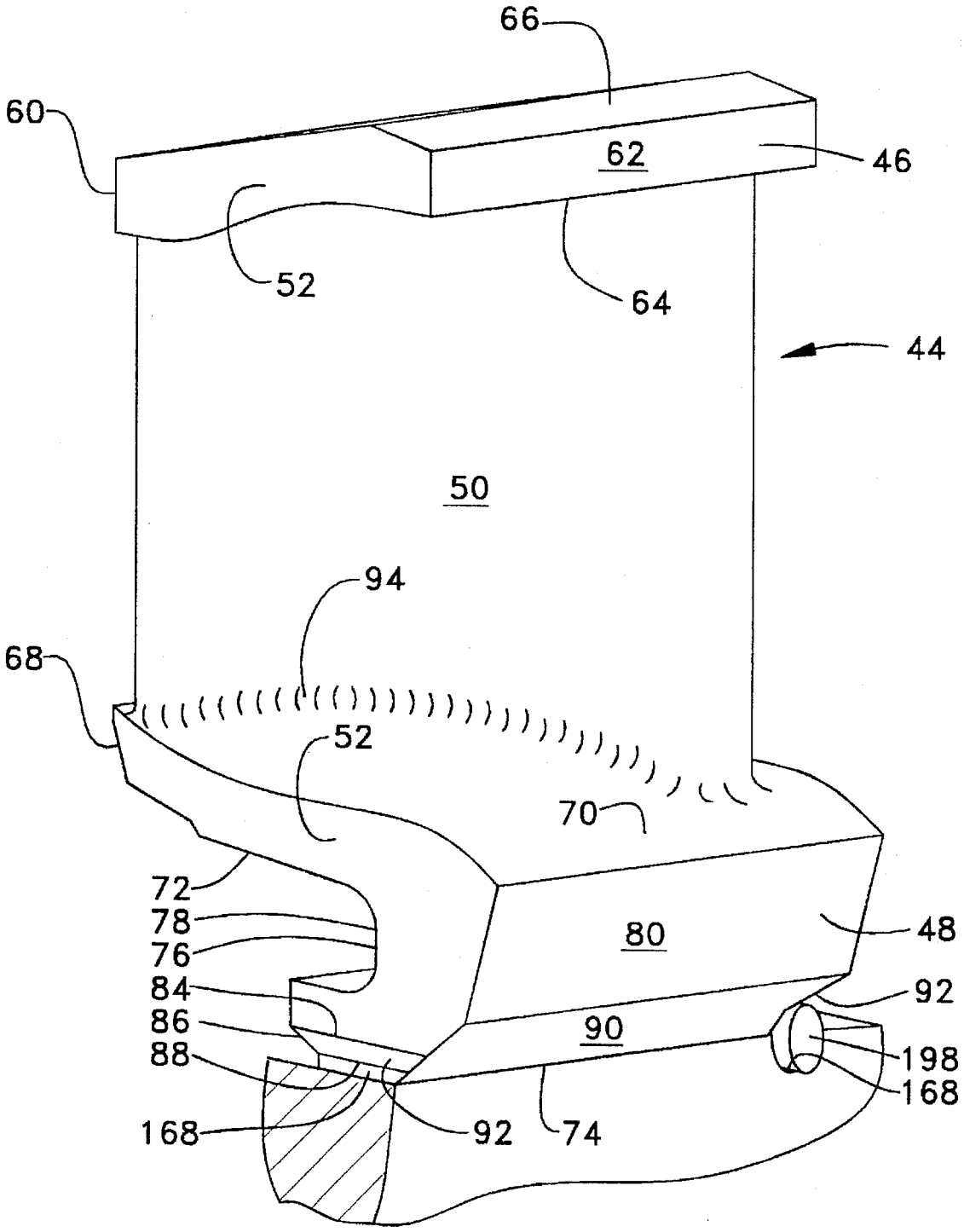
FIG. 3 is an enlarged isometric view of one of the plurality of segmented members.

As best shown in FIGS. 2 and 3, the outer annular ring member 46 includes a first end surface 60 adjacent the turbine section 12 and a second end surface 62 adjacent the combustor section 14. The outer annular ring member 46 further includes an inner axisymmetric surface 64 being connected to an end of the airfoil 50 and an outer axisymmetric surface 66 being opposite the inner axisymmetric surface 64. Each of the inner axisymmetric surface 64 and the outer axisymmetric surface 66 extends between the first end surface 60 and the second end surface 62. The inner annular ring structure 48 includes a first end surface 68 being positioned adjacent the turbine section 12, an outer axisymmetric surface 70 extending from the first end surface 68 toward the combustor section 14 and an inner planer surface 72 extending from the first end surface 68 toward the combustor section 14. The inner annular ring structure 48 has a hooked end 74 thereon at the end opposite the first end surface 68. The hooked end 74 includes a radial portion 76 being defined by a wear surface 78 extending radially inwardly from the inner planer surface 72 and a contacting surface 80 extending radially inwardly from the outer axisymmetric surface 70. The hooked end 74 further includes a tang portion 82 being defined by a horizontal surface 84 extending axially from the wear surface 78 toward the turbine section 12, a radial surface 86 extending radially inwardly from the horizontal surface 84, a bottom surface 88 extending axially from the radial surface 86 toward the combustor section 14 and a ramp portion 90 interconnecting the bottom surface 88 with the contacting surface 80. The ramp portion 90 extends between the bottom surface 88 and the contacting surface 80 at about a 45 degree angle. The bottom surface 88 has a plurality of angled surfaces 92 formed at each of the first end 52 and the second end 54, as best shown in FIG. 3. Furthermore, in this application, each of the plurality of segmented members 44 are formed by a casting process and have a transition portion 94 interconnecting the airfoil 50 to each of the inner annular ring structure 48 and the outer annular ring member 46.

The outer sealing portion 40 includes an attaching member 100 interposed the outer case 18 and a cradling member 102. The cradling member 102 includes a first radial end portion 104 having a contacting surface 106 in contacting relationship with the second end surface 62 of the outer annular ring member 46. The cradling member 102 further includes a second radial end portion 108 having a contacting surface 116 in contacting relationship with the first end surface 60 of the outer annular ring member 46 and a connecting member 110 interconnecting the first radial end portion 104 with the second radial end portion 108 forming a generally channel shaped configuration. The attaching member 100 is fixedly attached to the connecting member 110 and generally applies a spring loading function to the cradling member 102 for sealing purposes. A space 124 is formed between the outer axisymmetric surface 66 of the outer annular ring member 46 and the connecting member 110. The space 124 is used for cooling, sealing and provides a space for radial movement of the shroud due to thermal growth.

The inner mounting portion 42 includes a radial arm member 130 attached to the engine structure in a conventional manner. The radial arm member 130 includes a diaphragm 132 having a turbine side 134, a combustor side 136 and a connecting flange 138. A plurality of threaded holes 140 are positioned in the combustor side 136 radially inward of the connecting flange 138 of the diaphragm 132. The connecting flange 138 includes an outer tapered peripheral surface 150 being adjacent the inner planer surface 72 of the inner annular ring structure 48 and a first end 152 radially extends inwardly from the outer peripheral surface 150 to a horizontal bottom surface 154 which extends axially from the end 152 toward the combustor side 136 and terminates at the turbine side 134. The connecting flange 138 further includes a toroidal second end 156 extending inwardly from the outer tapered peripheral surface 150 and is positioned opposite the first end 152. A recess 160 is formed by a first horizontal surface 162 extending from the toroidal second end 156, a radial surface 164 extending radially inwardly from the horizontal surface 162 and terminating at a second horizontal surface 166 extending from the radial surface 164 to the combustor side 136. The second horizontal surfaces 166 includes a plurality of semi-circular recesses 168 positioned therein. The quantity of recesses 168 is equivalent to the number of plurality of segmented member 44.

The inner mounting portion 42 further includes a formed spring retainer 170 and a sealing member 172 removably attached to the diaphragm 132. The retainer 170 includes a first end portion 174 having a plurality of holes 176 positioned therein in which a plurality of fasteners 178 removably attach with the respective plurality of threaded holes 140. A second end portion 180 of the retainer 170 includes a radiused portion 182 defining an abutting surface 184 which is in contact with the ramp portion 90 and forcibly positions the horizontal surface 162 of the recess 160 into contacting relationship with the horizontal surface 84 of the hooked end 74, the toroidal second end 156 of the recess 160 into contacting relationship with the wear surface 78 of the hooked end 74 and the outer tapered peripheral surface 150 of the connecting flange 138 into contacting relationship with the inner planer surface 72 of the inner annular ring structure 48. The sealing member 172 is interposed the inner annular ring structure 48 and the inner mounting portion 42 and has a first end portion 190 having a plurality of holes 192 therein through which the plurality of threaded fasteners 178 removably attach the sealing member 172 to the diaphragm 132. The sealing member 172 further includes a second end portion 194 defining a radiused sealing surface 196 being in contacting relationship with the contacting surface 80 of the hooked end 74. The inner mounting portion 42 further includes a pin 198 being positioned in aligning relationship between respective ones of the plurality of angled surfaces 92 of respective ones of corresponding ones of the plurality of segmented members 44 and the corresponding one of the plurality of semi-circular recesses 168 in the diaphragm 132.

INDUSTRIAL APPLICABILITY

In operation, air from the compressor section 16 is delivered to the combustor 28 of the combustor section 14. Fuel is mixed with the air and combustion occurs. The hot gases pass through the first stage nozzle and shroud assembly 34 and are directed to the turbine section 12. The following operation will be directed to the first stage nozzle and shroud assembly 34; however, the functional operation of the remainder of the nozzle and shroud assemblies (outer annular ring member, inner annular ring structure and airfoils) could be very similar if implemented to use the mounting means 36. A nozzle and shroud assembly being fixedly or rigidly connected to the mounting structure 38 of the gas turbine engine 10 has been found to exhibit undesirable stress when subjected to gas flow exiting the combustor 28. The present mounting means 36 permits the nozzle and shroud assembly 34 to more easily flex and move through thermal expansion and contraction due to changes in temperature when subjected to the temperature gradients within the gas flow path. Thus, stresses are reduced.

In the assembled position, the outer annular ring member 46 is positioned within the outer sealing portion 40. The first end surface 60 and the second end surface 62 of the outer annular ring member 46 are in contacting relationship with the contacting surface 106 of the first radial end portion 104 and the contacting surface 116 of the second radial end portion 108 of the cradling member 102 respectively. Thus, the outer mounting is complete, the first and second end surfaces 60,62 of the outer annular ring member 46 are free to slide or move with respect to the contacting surfaces 106,116 of the outer sealing portion 40. Furthermore, the outer axisymmetric surface 66 of the outer annular ring member 46 is spaced from the connecting member 110 providing a space 124 for thermal insulation and compensation for any circumferental growth.

In the assembled position, the hooked end 74 of the inner annular ring structure 48 has the tang portion 82 positioned within the recess 160. The second end portion 180 having the radiused portion 182 of the spring formed retainer 170 forcible positions the horizontal surface 84 of the hooked end 74 in contacting relationship with the first horizontal surface 162 of the recess 160, the wear surface 78 of the hooked end 74 in contacting relationship with the toroidal second end 156 of the connecting flange 138 of the inner mounting portion 42, and the inner planer surface 72 of the inner annular ring structure 48 in contacting relationship with the outer tapered peripheral surface 150 of the connecting flange 138. Thus, the inner mounting is complete and the inner annular ring structure 48 with its hooked end 74 is free to slide or move with respect to the contacting surfaces as the components expand and contract.

As the metallic components of the engine expand at a higher rate than the ceramic components due to the higher rate of thermal expansion of the metallic components the diaphragm 132 will radially expand carrying the nozzle and shroud assembly 34 with it. The outer axisymmetric surface 66 of the outer annular ring member 46 will move into closer relationship with the connecting member 110 and the connecting member 110 partially filling the space 124 therebetween. The space 124 is however designed so that a portion thereof will always remain. Thus, the primary advantages of the improved nozzle and shroud assembly 34 configuration and the mounting means 36 are as follows. The configuration enables the nozzle and shroud assembly 34 to be made of a material, such as ceramic, having a relative low resistance to internal thermal stresses and a relative high resistance to temperatures. Thus, the nozzle and shroud assembly 34 can be used to increase efficiency of the gas turbine engine by using higher temperature combustion gases. The configuration further increases the longevity of the nozzle and shroud assembly 34 by reducing internal thermal stress, reducing down time and maintenance.

Other aspects, objects and advantages of this invention can be obtained from a study of the drawings, the disclosure and the appended claims.

It is claimed:

1. A nozzle and shroud assembly being adapted for use in a gas turbine engine having a mounting structure defining an outer sealing portion having a cradling member and an inner mounting portion defining a recess being defined by a first horizontal surface and a toroidal end, said nozzle and shroud assembly comprising:

an annular ring member having a first end surface, a second end surface and an outer axisymmetric surface, said first end surface, said second end surface and said outer axisymmetric surface being positioned within the cradling member and said outer axisymmetric surface being spaced from said cradling member forming a space therebetween;

an annular ring structure having a hooked end, defining a tang portion, being in contacting relationship with said inner mounting portion; and an airfoil being interposed and attached to said annular ring member and said annular ring structure.

2. The nozzle and shroud assembly of claim 1 wherein said annular ring member is slidably positioned within said cradling member.

3. The nozzle and shroud assembly of claim 1 wherein said mounting structure has a preestablished rate of thermal expansion and said outer annular ring member, said annular ring structure and said airfoil have a lower rate of thermal expansion than said mounting structure.

4. A gas turbine engine comprising:

a mounting structure defining an outer sealing portion having a cradling member and an inner mounting portion defining a recess, said recess being defined by a first horizontal surface and a toroidal end;

an annular ring member having a first end surface, a second end surface and an outer axisymmetric surface, said first end surface, said second end surface and said outer axisymmetric surface being positioned within the cradling member and said outer axisymmetric surface being spaced from said cradling member forming a space therebetween;

an annular ring structure having a hooked end being in contacting relationship with said inner mounting portion, said hooked end including a tang portion positioned therein, and said tang portion includes a horizontal surface being in contacting relationship with the first horizontal surface;

an airfoil being interposed and attached to said annular ring member and said annular ring structure.

5. The gas turbine engine of claim 4 wherein said annular ring member is slidably positioned within said cradling member.

6. The gas turbine engine of claim 4 wherein said mounting structure has a preestablished rate of thermal expansion and said annular ring member, said annular ring structure and said airfoil have a lower rate of thermal expansion than said mounting structure.

7. The gas turbine engine of claim 4 wherein said inner mounting portion includes a wear surface being in contacting relationship with the toroidal end.

8. The gas turbine engine of claim 7 wherein said annular structure includes an inner planer surface and said inner mounting portion includes an outer tapered peripheral surface being in contacting relationship with said inner planer surface.

9. The gas turbine engine of claim 8 wherein said gas turbine engine includes a formed spring retainer being removably attached to the inner mounting portion and retaining said horizontal surface in contacting relationship with the first horizontal surface, said wear surface in contacting relationship with the toroidal end and said inner planer surface in contacting relationship with said outer tapered peripheral surface.

10. The gas turbine engine of claim 4 wherein said annular member, said annular structure and said plurality of airfoils form a nozzle and shroud assembly defining said inner mounting portion having a plurality of recesses defined therein at least a portion thereof having a pin therein positioning the nozzle and shroud assembly thereon the inner mounting portion.

11. The gas turbine engine of claim 4 wherein said annular member, said annular structure and said plurality of airfoils form a nozzle and shroud assembly including a plurality of segmented members and a pin positions a respective one of the plurality of segmented members on the inner mounting portion.

12. The gas turbine engine of claim 4 wherein said gas turbine engine further includes a sealing member interposed the annular ring structure and the inner mounting portion.

* * * * *

UNITED STATES PATENT AND TRADEMARK OFFICE

CERTIFICATE OF CORRECTION

PATENT NO. : 5,653,580

DATED : August 5, 1997

INVENTOR(S) : Leslie J. Faulder et al.

It is certified that error appears in the above-identified patent and that said Letters Patent is hereby corrected as shown below:

Claim 3; Line 3: Please delete the word "outer", which appears before the word annular Signed and Sealed this Ninth Day of December, 1997

Bruce Lehman

*Attest:*

BRUCE LEHMAN

*Attesting Officer*

*Commissioner of Patents and Trademarks*